US005461367A

United States Patent [19]

Altavela et al.

[11] Patent Number: 5,461,367

[45] Date of Patent: Oct. 24, 1995

[54] ELECTRIC PANEL FIRE ALARM

[75] Inventors: Edward T. Altavela; Glenn R. McComber, Jr., both of Webster, N.Y.

[73] Assignee: Apex Power Systems, Inc., Webster, N.Y.

[21] Appl. No.: 243,221

[22] Filed: May 16, 1994

[51] Int. Cl.[6] ..... G08B 17/06

[52] U.S. Cl. ..... 340/584; 340/594; 340/693

[58] Field of Search ..... 340/594, 584, 340/693

[56] References Cited

U.S. PATENT DOCUMENTS 4,088,986 5/1978 Boucher ..... 340/693
4,698,621 10/1987 Masot ..... 340/693
4,712,095 12/1987 Georgis, II ..... 340/584
4,855,721 8/1989 Hallett et al. ..... 340/693
4,866,427 9/1989 Sciscoe ..... 340/594
5,072,211 12/1991 Clement ..... 340/521

*Primary Examiner*—Glen Swann, III
*Attorney, Agent, or Firm*—Eugene Stephens & Associates

[57] ABSTRACT

A fire alarm for an electric panel cabinet mounts a temperature sensor to monitor the internal cabinet temperature and sound an alarm if the inside of the cabinet becomes too hot. The alarm device preferably has an auxiliary battery power supply in case overheating within the cabinet causes a power failure. The alarm can be mounted remotely from the panel cabinet or directly, preferably by a threaded conduit nipple secured to an alarm enclosure box and mounted within a knockout opening in the panel wall.

13 Claims, 5 Drawing Sheets

ELECTRIC PANEL FIRE ALARM

FIELD OF THE INVENTION

This invention involves a fire alarm for an electric panel cabinet.

BACKGROUND

This invention involves recognition of the fire hazard presented by electric panel cabinets housing main electric service panels or subpanels for the electric supply to a building. Electric panel cabinets contain many components that can overheat and start fires; and these include: feeder conductors, branch circuit conductors, main circuit breakers, branch circuit breakers, and bus bars. The overheating of electrical components within an electric panel cabinet can be caused by loose or corroded connections or power overloads and can ignite a fire in the cabinet, which can spread to nearby building components.

Smoke alarms, which are required by the majority of local building codes throughout the United States, are not adequate protection against fires started in electric panel cabinets. The smoke alarms may not be located near the electric panel cabinet; and even if they are, they actuate only after a fire is sufficiently established to produce smoke. Smoke alarms are also required to be powered by the building's electrical service; and a fire started in an electric panel cabinet can cause a loss of electrical power after the fire is started, which would disable the typical smoke detector.

High temperature alarms have been suggested for purposes other than electric panel cabinets. These include the stovepipe alarm suggested in U.S. Pat. No. 4,866,427 and the safe alarm suggested in U.S. Pat. No. 5,072,211. Also, high temperature responsive shutoff switches have been suggested for shutting off overheated appliances.

We have found no evidence that high temperature alarms have been suggested for electric panel cabinets, though. We have also found that applying an alarm to an electric panel cabinet involves special problems because of the power supply components that it houses and the possibility of a power failure when an alarm is required.

SUMMARY OF THE INVENTION

We have recognized the importance of a high temperature alarm for an electric panel cabinet and have devised an efficient way of providing one. Our alarm mounts quickly and conveniently on an existing electric panel cabinet and can be incorporated directly into the cover of a panel during its manufacture. It uses a national electric code approved enclosure for components of the alarm and has a power supply that preferably includes a battery and an automatic switch to battery power upon failure of external power.

An alarm temperature sensor extends from the enclosure to a position where it can detect an alarm temperature occurring within the panel cabinet. This is preferably done by extending the sensor through a threaded rigid conduit nipple attachable to the panel cabinet via a knockout opening and locknuts. An alarm device is actuated when the sensor detects an alarm temperature within the electric panel cabinet, and the power supply operates the alarm device to warn of the danger.

DRAWINGS

DETAILED DESCRIPTION

Figure 1:
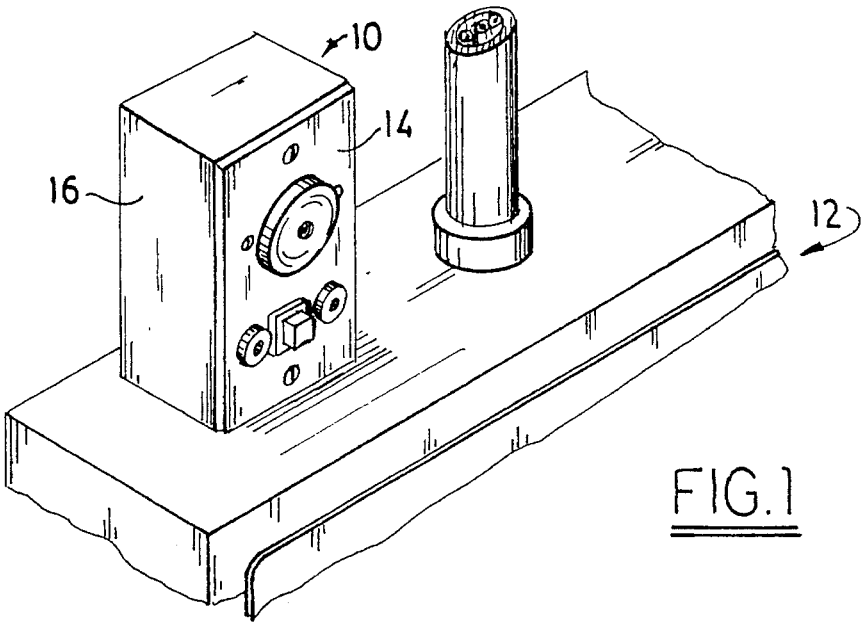
FIG. 1 is a general perspective view of a fire alarm mounted on the top of a typical electric panel cabinet.
Figure 8:
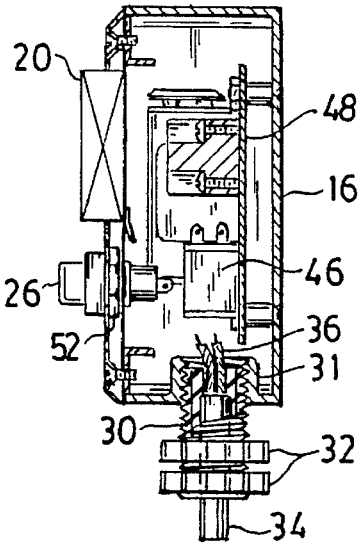
FIG. 8 is a side cross-sectional view from line 8—8 of FIG. 2 of the fire alarm box exposing internal components.
Figure 9:
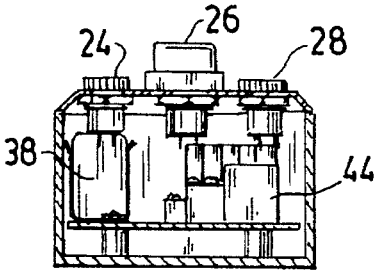
FIG. 9 is a bottom cross-sectional view from line 9—9 of FIG. 2 of the fire alarm box exposing internal components.

A preferred mounting of the inventive alarm 10 on an electric panel cabinet 12 is shown in FIG. 1. Fire alarm 10 is contained within an enclosure box 16 having a cover plate 14. Box 16 is connected to the top of panel cabinet 12, but can also be connected to other regions of cabinet 12. The illustrated form of box 16 that we prefer is a common metal, one gang style, suitable for accommodating one electrical device, and having a threaded female hub 31 (FIG. 8). Box 16 should meet or exceed national electrical code standards. It may also be manufactured as a custom design using various materials that meet with Underwriters Laboratories' approval, such as injection molded polystyrene or polycarbonate. A usable box 16 is available from Pass & Seymour, Inc. of Syracuse, N.Y., Model No. WPB23.

Figure 2:
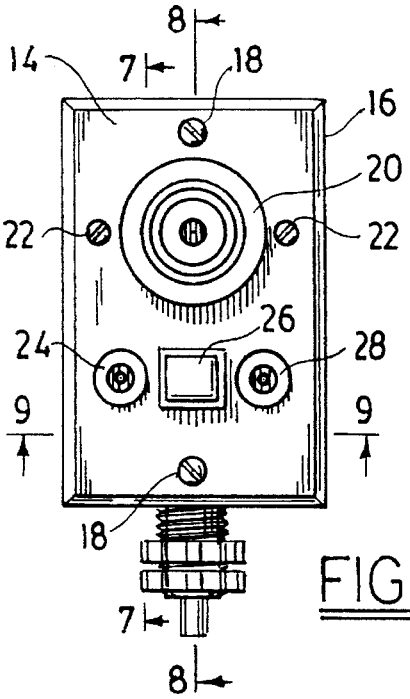
FIG. 2 is a front view of the fire alarm.
Figure 6:
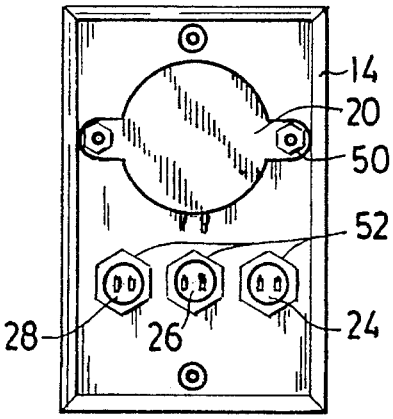
FIG. 6 is a back view from line 6—6 of FIG. 3 of the front cover plate of the fire alarm.
Figure 7:
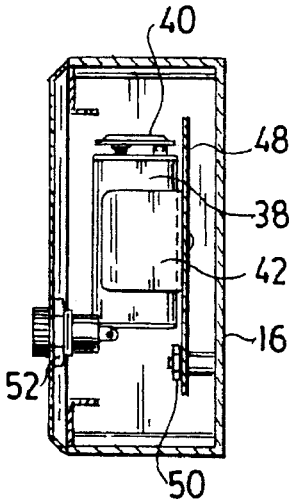
FIG. 7 is a side cross-sectional view from line 7—7 of FIG. 2 of the fire alarm box exposing internal components.

Referring to FIGS. 2 and 6, the illustrated cover 14 is one gang blank metal type which is attached to box 16 by threaded cover screws 18. An audible alarm 20 is mounted to cover 14 through a hole formed in it and fastened with machine screws 22, which are secured with fastening nuts 50. A usable alarm 20 is a pulsating piezo type and is available from Radio Shack Corporation, U.S.A, Model No. 273-066. Visual and remote alarms are also possible, and the invention is not limited to an alarm that is audible.

Figure 5:
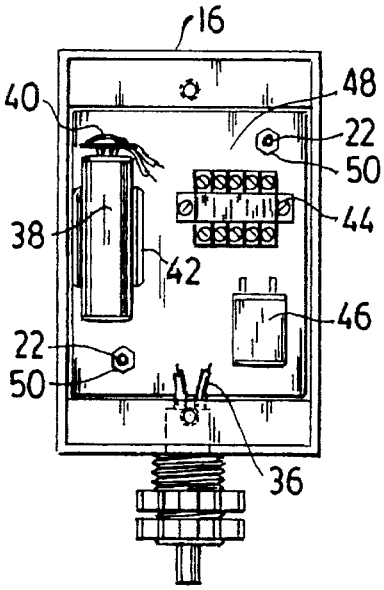
FIG. 5 is a front, internal view from line 5—5 of FIG. 3 of the box and components of the fire alarm.

A single pole momentary contact push test button 26 having a threaded shaft is mounted to cover 14 through a hole formed in it and secured with threaded nut 52. A single pole remote alarm output jack 24 having a threaded shaft is mounted to cover 14 through a hole formed in it and secured with nut 52. A single pole external power supply input jack 28 having a threaded shaft is also mounted to cover 14 through a hole formed in it and secured with a nut 52. Remote alarm output 24, test button 26, and external power supply input 28 are electrically connected to a multiple pole terminal block 44 shown in FIG. 5. A usable terminal block 44 is available from Altech Corporation, 35 Royal Road, Flemington, N.J., Model No. 125-130.

Figure 3:
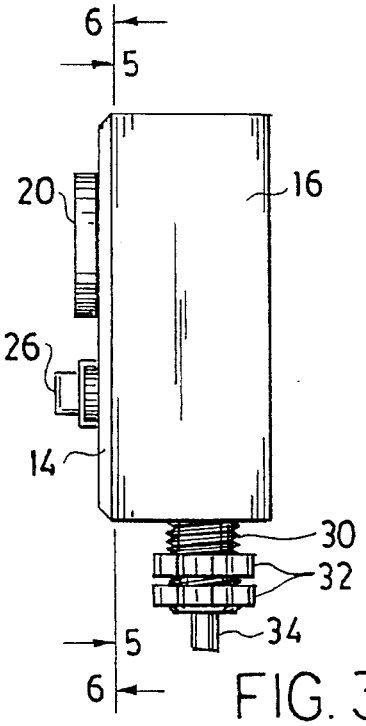
FIG. 3 is a side view of the fire alarm.
Figure 4:
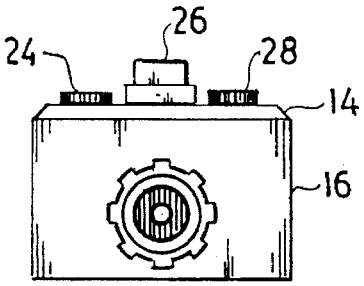
FIG. 4 is a bottom view of the fire alarm.

Referring to FIGS. 3, 4, and 8, a threaded rigid conduit nipple 30 is attached to box 16 by threading it into the provided threaded female hub 31 located at the base of enclosure box 16. Two locknuts 32 are provided and threaded onto nipple 30 and are used for attaching nipple 30 within a knockout opening in a wall of electric panel cabinet 12 in the usual and approved way, with locknuts 32 on opposite sides of the panel wall.

A bi-metallic, single pole, close-on-temperature-rise temperature sensing probe 34 passes through nipple 30 and is exposed just external to nipple 30. Temperature probe 34 is electrically attached to terminal block 44 by electrical leads 36 shown in FIG. 5. A usable temperature sensing probe 34 is a bi-metallic type available from Thermtrol Corporation of North Canton, Ohio. Sensor 34 is preset at the factory at a preselected temperature at which it will trigger. We have found that a useful temperature setting is 135° F.

Connecting alarm enclosure 16 to electric panel cabinet 12 via a threaded nipple 30 extending through a knockout opening in the wall of cabinet 12 disposes sensor 34 just inside of electric panel cabinet 12. There it is positioned to detect an alarm temperature indicating overheating of components within cabinet 12 so that the alarm can warn of the unsafe condition.

Figure 11:
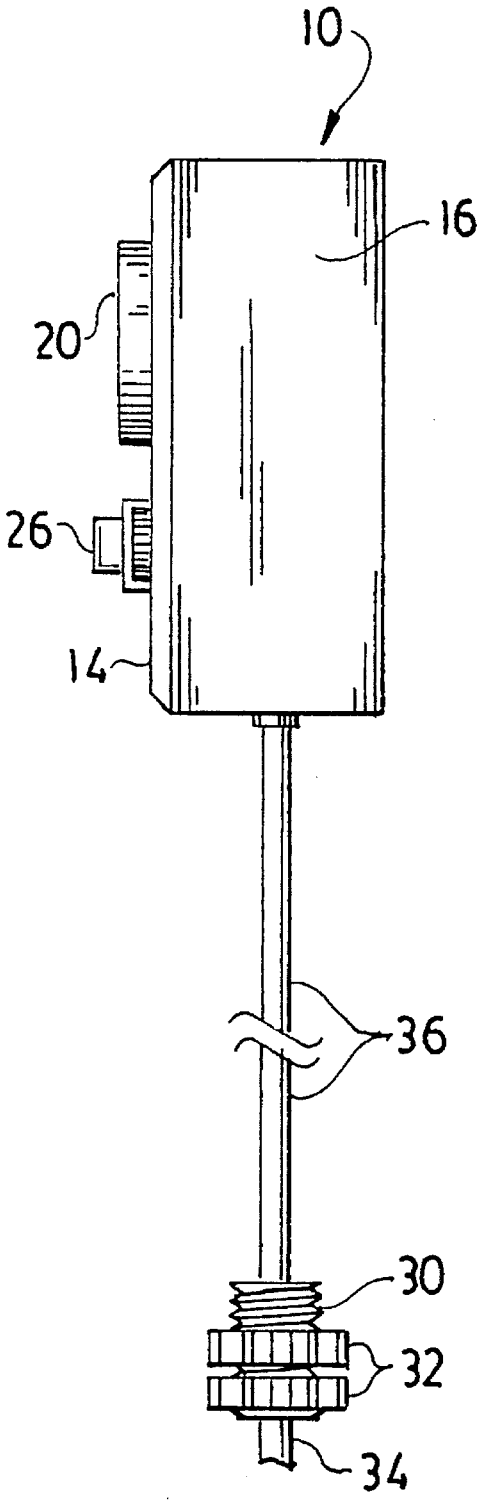
FIG. 11 is an illustrated general view of the fire alarm showing a remote temperature sensor.
Figure 12:
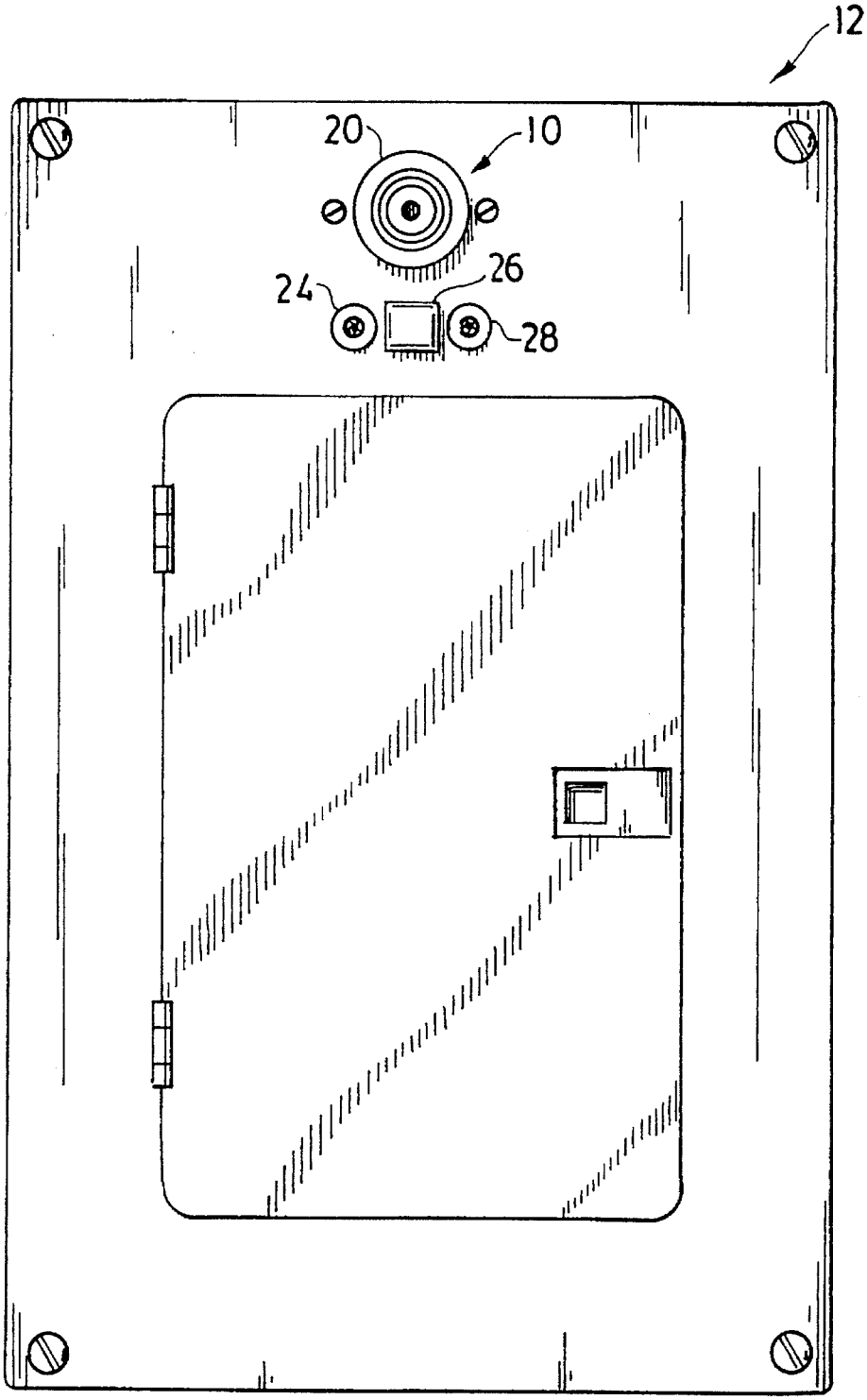
FIG. 12 is a front view of an electric panel cabinet showing alternative mounting of the fire alarm in the front cover of the panel.

Enclosure box 16 can also be spaced away from electric panel cabinet 12, while sensor 34, in combination with threaded nipple 30, is mounted in the proper position in a knockout opening in a wall of cabinet 12. This is made possible simply by disconnecting sensor 34 electrically from terminal block 44, unthreading nipple 30 from hub 31, and extending the electrical leads 36 for sensor 34 to span the distance between alarm enclosure 16 and panel 12. Such a remote arrangement of sensor 34, nipple 30, and locknuts 32, for remote connection to electric panel 12, is shown in FIG. 11.

Referring to FIGS. 5 and 7–9, a non-conductive component chassis board 48 is preferred for mounting components within box 16. Chassis board 48 is mounted to box 16 with screws 22 and secured with nuts 50. A 9-volt direct current battery 38 is held in place by a battery holder 42 preformed out of spring steel which in turn is mounted to chassis 48 with a screw and nut (not shown). A battery wiring harness 40 is provided and wire leads from this are electrically attached to terminal block 44 which is mounted to chassis 48. A double pole, double throw battery/power supply relay 46 with a 9-volt direct current coil is mounted to chassis 48 and wire leads electrically attached to block 44. A usable relay 46 is available from Radio Shack Corporation, U.S.A, Model No. 275-005.

Figure 10:
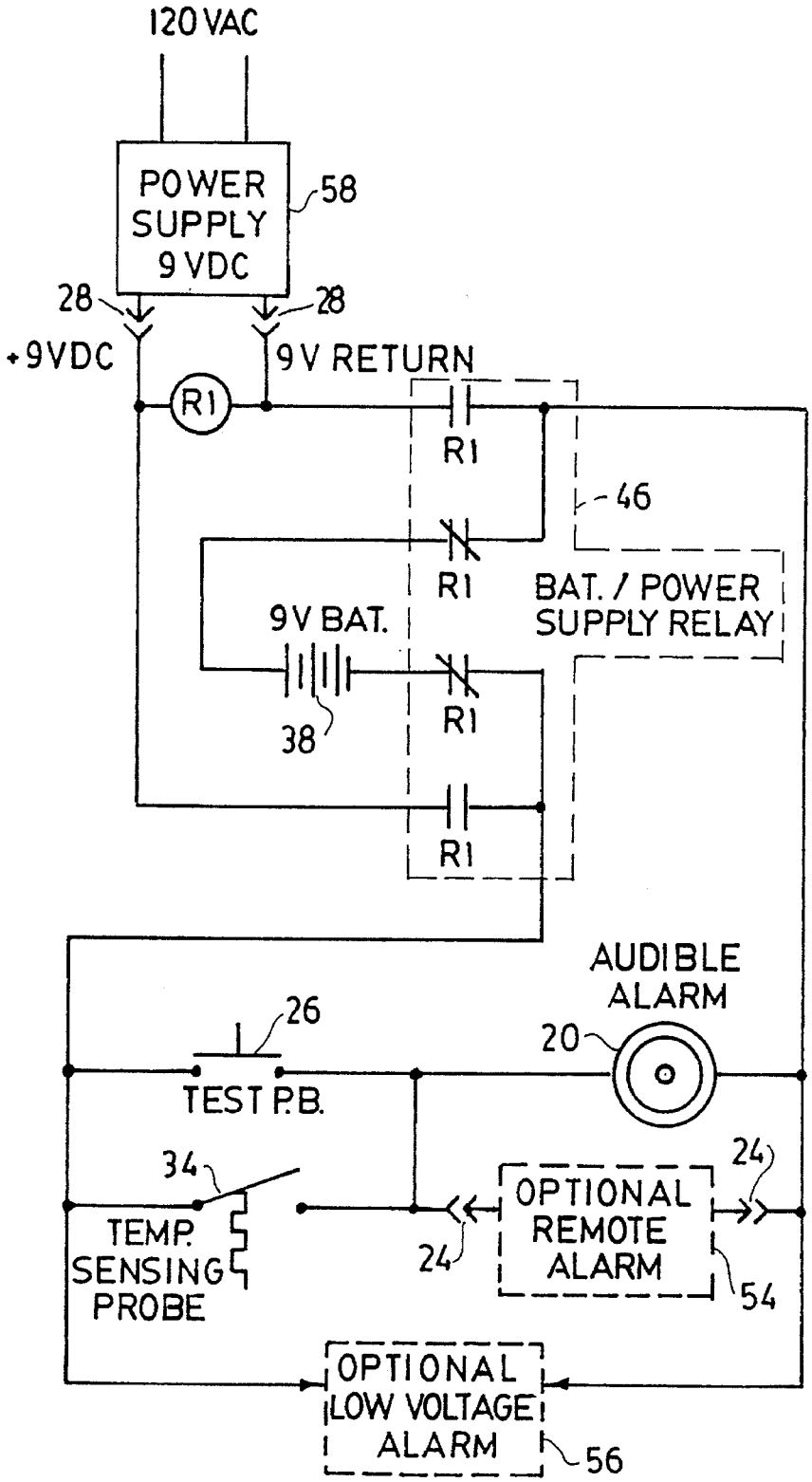
FIG. 10 is an electrical schematic diagram of the fire alarm.

Referring to FIG. 10, an electrical schematic of the present invention illustrates the electrical connections between the battery/power relay 46, power supply input 28, battery 38, 9-volt direct current battery eliminator 58, temperature probe 34, audible alarm 20, and test button 26. Also illustrated are an optional low voltage alarm 56 to warn of a weak battery 38 and an optional remote alarm 54 utilizing provided remote alarm output 24.

In operation, the fire alarm is typically mounted externally on the user's electrical panel cabinet 12 or similar equipment using knockout holes provided in such cabinets. Nipple 30 is extended through a knockout hole in a wall of a panel cabinet 12 and is secured in such position with locknuts 32. This positions temperature sensing probe 34 just within electrical cabinet 12 where it is exposed to internal ambient temperatures and can actuate alarm device 20 when the internal cabinet temperature exceeds a predetermined level. A similar mounting of sensor 34 can be accomplished from a remote enclosure box 16, as shown in FIG. 11.

Under normal operating conditions, the system may use an optional external power source comprising a 120-volt alternating current to 9-volt direct current battery eliminator 58 plugged into external power supply input 28. In the event of an external power failure, alarm 10 will automatically transfer by means of the 9-volt direct current double pole double throw battery/power supply relay 46 from the external battery eliminator 58 to internal battery 38. A usable battery eliminator 58 is available from Radio Shack Corporation, Fort Worth, Tex., Model No. 65-731.

When temperature probe 34 senses a fire or alarm temperature condition within electrical panel cabinet 12, a bi-metallic contact switch located within probe 34 closes on temperature rise at a preselected value completing a circuit which initiates a 9-volt direct current signal from either the battery eliminator 58 plugged into external power supply input 28 or the internal 9-volt battery 38 by means of the battery/power relay 46, to activate audible alarm 20.

A momentary contact test button 26 is provided for the purpose of testing the presence of a power source and the operability of audible alarm 20 to insure the system is powered and operational. An optional low voltage alarm 56 may be provided in the control circuit to indicate, preferably in an audible pulsating fashion, a weakening battery 38 that should be replaced. To use alarm 10 as an initiating sensor, remote alarm output 24 provides a means to interface with an external multiple zone fire alarm system. An optional remote alarm 54 may also be provided using remote alarm output 24 to warn of a panel fire or over-temperature condition within the electric panel cabinet 12, at a remote location.

Many alternatives are available for the components shown in the illustrated preferred embodiment. For example, a printed circuit board can be substituted for terminal block 44 and the related electrical wiring, to reduce manufacturing costs. Also, many alternatives are available for enclosures, alarm devices, switches, and power supply components.

We claim:

1. A fire alarm for an electric panel cabinet, said alarm comprising:

a. an enclosure for components of the alarm;

b. a power supply for the alarm;

c. a sensor for detecting an alarm temperature, the sensor extending from the enclosure through a conduit nipple attachable to the panel cabinet via a knockout opening, the sensor being arranged relative to the nipple so that when the nipple is mounted in a knockout opening of the panel cabinet the sensor is in position to detect the alarm temperature occurring within the panel cabinet; and d. an alarm device powered by the power supply and actuated by the sensor detecting the alarm temperature within the electric panel cabinet.

2. The fire alarm of claim 1 wherein the nipple is secured to the enclosure so that mounting the nipple in a knockout opening of the panel cabinet mounts the enclosure on the panel cabinet.

3. The fire alarm of claim 1 wherein the power supply includes a battery and a power supply relay that automatically switches to battery power upon failure of external power.

4. The fire alarm of claim 3 wherein the power supply includes a low voltage detection alarm circuit to indicate weakening of the battery.

5. The fire alarm of claim 1 wherein the alarm device is remote from the enclosure and the electric panel cabinet.

6. The fire alarm of claim 1 wherein a conductor connected to the sensor extends between the enclosure and the nipple.

7. The fire alarm of claim 1 wherein the sensor is a bi-metallic element.

8. The fire alarm of claim 1 including a momentary contact push button arranged on the enclosure for testing the power supply and the alarm device.

9. The combination of a fire alarm and an electric panel cabinet, the combination comprising:

a. an enclosure attached to the electric panel cabinet;

b. a power supply for the alarm;

c. a sensor for detecting an alarm temperature, the sensor being in circuit with the power supply and disposed for detecting the alarm temperature within the electric panel cabinet;

d. an alarm device driven by the power supply and actuated by the sensor when the alarm temperature is sensed within the electric panel cabinet; and e. the enclosure being connected to a conduit nipple, and the nipple being connected to the electric panel cabinet via a knockout opening.

10. The combination of claim 9 wherein the enclosure is mounted on a cover of the electric panel cabinet.

11. The combination of claim 9 wherein the power supply includes a battery and a power supply relay that automatically switches to battery power upon failure of external power.

12. The combination of claim 11 wherein the power supply includes a low voltage detection alarm circuit to indicate weakening of the battery.

13. The combination of claim 9 wherein the alarm device is remote from the enclosure and the electric panel cabinet.

* * * * *